US005088175A

United States Patent [19]

Nakamura et al.

[11] Patent Number: 5,088,175

[45] Date of Patent: Feb. 18, 1992

[54] CYLINDER LOCK MANUFACTURING METHOD

[75] Inventors: Hiroshi Nakamura; Yoshinobu Saita; Hitoshi Ikeda, all of Miyazaki, Japan

[73] Assignee: Kabushiki Kaisha Honda Rokku, Miyazaki, Japan

[21] Appl. No.: 262,657

[22] Filed: Oct. 26, 1988

[30] Foreign Application Priority Data

Oct. 29, 1987 [JP] Japan ..... 62-273912

[51] Int. Cl.[5] ..... B21D 39/03

[52] U.S. Cl. ..... 29/430; 29/469; 29/564.2

[58] Field of Search ..... 29/430, 429, 469, 564.1, 29/564.2, 783, 784, 791, 804

[56] References Cited

U.S. PATENT DOCUMENTS 3,111,748 11/1963 Doll et al. ..... 29/804
3,264,742 8/1966 Roland ..... 29/804
3,378,908 4/1968 Buller ..... 29/804
3,664,007 5/1972 Schlage ..... 29/804
3,668,909 6/1972 Roberts ..... 29/804

FOREIGN PATENT DOCUMENTS 0914232 3/1982 U.S.S.R. ..... 29/804

*Primary Examiner*—Irene Cuda
*Attorney, Agent, or Firm*—Armstrong, Nikaido, Marmelstein, Kubovcik & Murray

[57] ABSTRACT

A cylinder lock manufacturing method wherein a plurality of cylinder locks differing in place of use but using a common key for their unlocking are taken as a group having a specific key code assigned thereto. The inner members and outer members of cylinder locks are assembled into respective cylinder locks continuously for one group after another with change of the key code. A key for each group of the locks is notched synchronously with the cylinder assembly process. The cylinder locks and the key so produced through the above processes are combined as a set.

4 Claims, 2 Drawing Sheets

CYLINDER LOCK MANUFACTURING METHOD

BACKGROUND OF THE INVENTION

This invention relates to a cylinder lock manufacturing method in which a plurality of cylinder locks that are used in different places but can be unlocked by a common key such as the various locks in an automobile are manufactured as a set of locks complete with a common key.

Cylinder locks used in an automobile include a steering column lock, door cylinder locks for both the left- and right-side doors, and a trunk lock, etc., all of which have the same key number and use a common key for their unlocking.

To manufacture a plurality of such cylinder locks having the same key number and using a common key but used in different places, as shown in FIG. 3, inner members thereof obtained through an inner member casting process a have tumblers assembled into them by an automatic tumbler assembling machine and thereafter are conveyed to respective assembly lines such as a steering column lock assembly line c, a right-side door lock assembly line d, a left-side door lock assembly line e, and a trunk lock assembly line f so as to be assembled therealong as the respective locks. In the steering column lock assembly line c during this assembly process, the steering column lock being assembled is further combined with a key manufactured through a key-notch working process g and stored in a storing box h. The steering column lock now complete with the key is conveyed to a set line i, whereas in the other assembly lines, the cylinder locks are assembled without a key and moved to a stock yard j where they are lined up in order of key code number in each packet for each assembly line and kept for temporary storage. After their key code numbers are compared with that of the steering column lock with key which is moving along the set line i, they are transferred to the set line i to be grouped with the corresponding steering column lock with key which is moving along the set line i, they are transferred to the set line i to be grouped with the corresponding steering column lock with key and packed together therewith as a group of cylinder locks .using a common key for unlocking thereof.

In such a conventional method as described in the foregoing, it is not only complicated and troublesome to keep a stock of the cylinder locks stored temporarily in the stock yard j under control, but also impossible to group and pack them together in a set unless all the assembly lines are synchronized with one another. Furthermore, this process of grouping together the cylinder lock complete with the key and the other corresponding locks without it is carried out in a sort of card-pairing manner such that each of the respective locks from the respective packets in the stock yard of each line has to be compared individually with the lock complete with the key. This makes the grouping process quite troublesome and inconvenient.

The present invention whose objective is to solve such problems as noted above provides a cylinder lock manufacturing method wherein a plurality of cylinder locks using a common key for their unlocking but used in different places are taken as a group having a specific key code assigned thereto. The cylinder assembly process in which inner members and outer members of cylinder locks are assembled into respective cylinder locks is carried out continuously for one group after another with change of the key code. The key notch working process in which a key for each group of the locks is notched is carried out synchronously with the cylinder assembly process. The cylinder locks and the key so produced through these processes are then combined as a set.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF A PREFERRED EMBODIMENT

Figure 1:
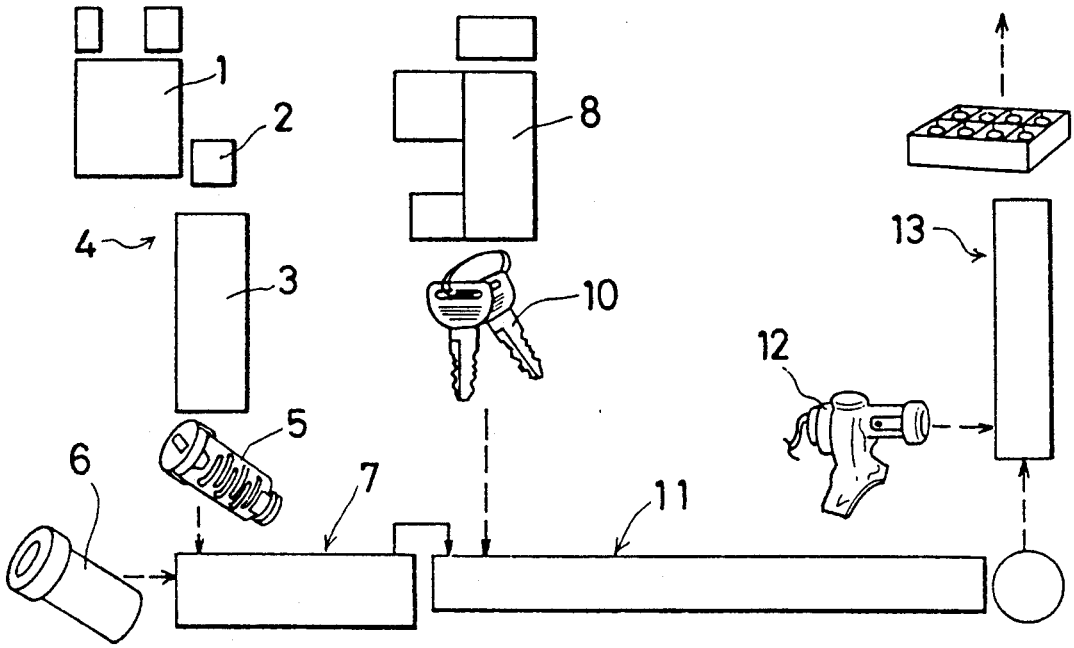
FIG. 1 is a schematic block diagram illustrating an assembly line of the present invention.

Referring to the drawings, a cylinder lock manufacturing method according to the present invention will now be explained as follows:

The use of the term "station" hereinafter is not intended to be limited to a single physical site, but rather, is intended to mean a general area or process through which the various named components move in carrying out the inventive method.

FIG. 1 shows a flowchart showing a process flow line according to the present invention: Inner members are initially prepared at station (4) by an inner member casting machine (1) that casts inner members one by one. A trimming machine (2) removes casting fins from the inner members cast by the casting machine (1). A chromate treatment machine (3) applies a chromate treatment to the inner members which have had their fins removed by trimming machine (2). The cylinders are assembled at station (7) where the tumblers are inserted into the inner members (5) already treated in the supplying process (4). These inner member assemblies are inserted into outer members (6) supplied from another line. The key is prepared at a key notch working station (9) which includes a key notch working machine (8) designed to cut notches on a key. At a key/lock set assembly station (11), a particular key (10) notched in the key notch working station (9) and a plurality of the respective cylinder locks assembled in the cylinder assembly station (7) to be used in different places but unlocked by that particular key (10) are grouped together to make a set of locks complete with a common key. At a steering column body assembly station (13), the steering column lock is taken out of one set of the cylinder locks grouped together in the key/-lock set assembly station (11) and is inserted into a steering column body (12).

Figure 2:
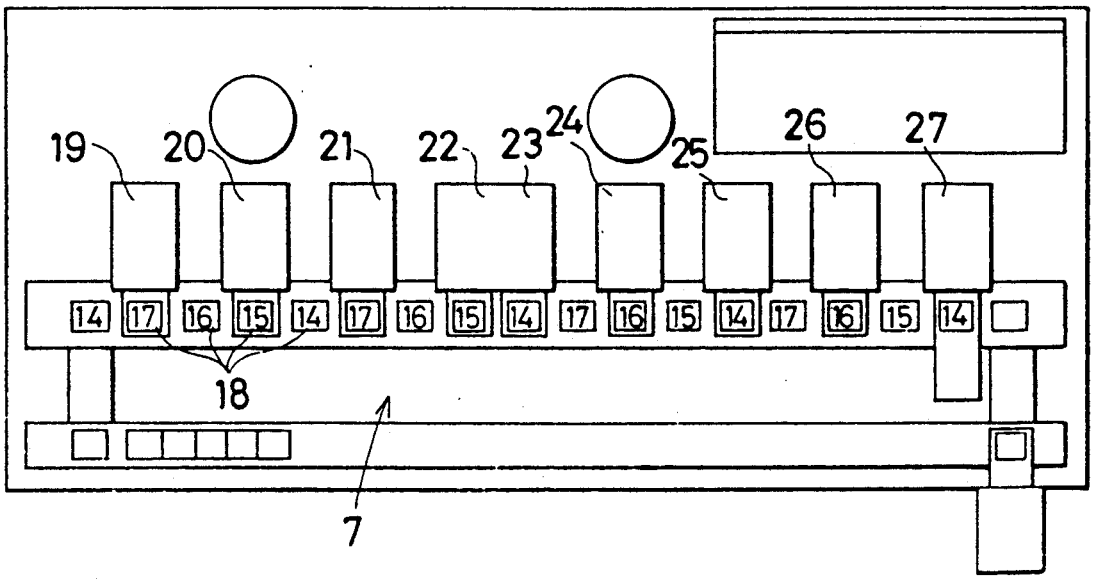
FIG. 2 is a schematic block diagram showing a cylinder assembly line.
Figure 3:
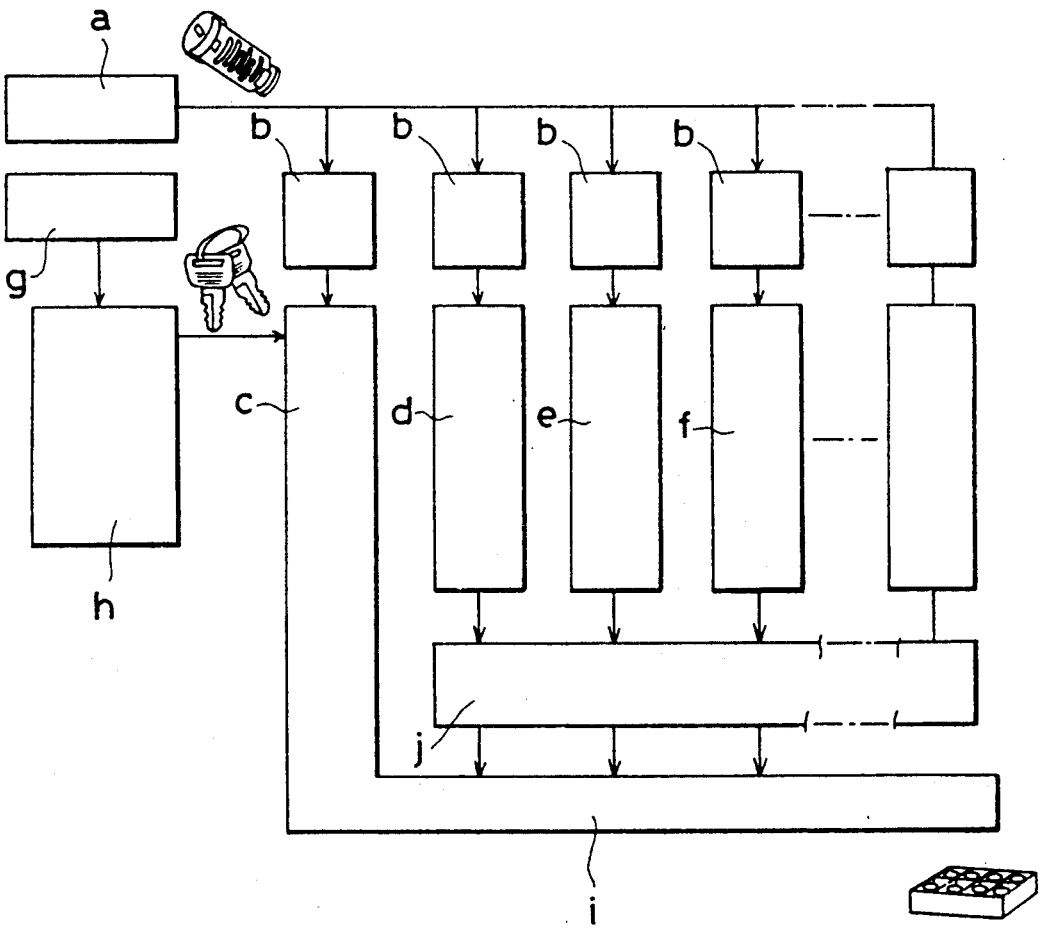
FIG. 3 is a schematic block diagram showing a conventional assembly line.

More in detail, the above-mentioned cylinder assembly station (7) includes, as shown in FIG. 2, a free flow line which moves pallets (18) continuously one after another, each pallet carrying the inner members (5) and the outer members (6) set on an individual lock basis for one group of the locks including a steering column lock (14), a right-side door lock (15), a left-side door lock (16) and a trunk lock (17) which differ in shape from one another but can be unlocked by a common key. Each pallet has an identification mark assigned thereto with the identification mark identifying each group of the cylinder locks. In this pallet (18) on the free flow line, the inner members (5) and the outer members (6) are marked at the predetermined spot thereof with a key number according to the identification mark by a key number marking device (19) provided along the line. Using a first lock spring device (20), a spring is inserted into a tumbler groove provided in one side of the inner member (5). Using a first automatic tumbler machine (21), a tumbler is inserted into a tumbler groove provided on one side of the inner member (5). The insertion of the tumbler is then inspected by a first inspection device (22). The inner member (5) is reversed by an inner member reversing device (23). Using a second lock spring device (24), a second spring is inserted into a tumbler groove provided on the other side of the inner member (5). Using a second automatic tumbler inserting machine (25), a tumbler is inserted into the tumbler groove provided on the other side of the inner member (5). Grease is then applied thereto by an inspection/-greasing device (26). Finally, the inner member (5) is inserted into the outer member (6) by a body inserting device (27). When one group of the cylinder locks (14), (15), (16) and (17) have been assembled in a group through the foregoing assembling steps, the front-running cylinder lock (14) of the next group is identified by the identification mark of a pallet carrying the group, and the key number is changed accordingly in the first and the second automatic tumbler inserting machines (21) and (25) so as to carry out the assembling steps for these cylinder locks (14), (15), (16) and (17) in that group. Thus, the key number is changed with each group and the assembling steps for each group of the cylinder locks (14), (15), (16) and (17) are carried out on a group basis. Thereafter, the cylinder locks (14), (15), (16) and (17) of that group are combined with their particular key (10) to make a complete set at the key/-lock set assembly station (11), the key (10) having been worked on by the key notch working machine (8) in a process performed synchronously with the foregoing assembly steps for the cylinder locks of the group. Then, of the cylinder locks (14), (15). (16) and (17) grouped together and combined with the key (10) as described in the foregoing, the steering column lock (14) is taken out of the group and inserted into the steering column body (12) while on the body assembly line (13), after which all are inspected on the line and packed together as a grouped set for shipment.

As described in the foregoing, according to this invention, a plurality of cylinder locks which are shaped differently for use in different places but unlocked by a common key are handled as a group throughout various steps and stages of the assembly process in which each of such groups is identified by a different key code and processed to have the inner and outer members of the group assembled in a continuous flow so that a plurality of cylinder locks grouped as above is treated as a group as they flow along the assembly line. As a result, a stock yard such as required in a conventional method of this kind is no longer necessary and a set operation in which a plurality of cylinder locks are grouped according to their key code so as to make a set thereof also is no longer necessary. In addition, since a common key for a group of cylinder locks is manufactured through the key notch working process performed synchronously with the cylinder lock assembly process so that the key is supplied on-site to the corresponding group of cylinder locks on the line and combined with the locks to make a complete set of a key and locks, a key storage box is also no longer necessary and it is not only easier to group the locks and the key properly in a set but also possible to carry out all the assembly works on one assembly line.

It is readily apparent that the above-described has the advantage of wide commercial utility. It should be understood that the specific form of the invention hereinabove described is intended to be representative only, as certain modification within the scope of these teachings will be apparent to those skilled in the art.

Accordingly, reference should be made to the following claims in determining the full scope of the invention.

What is claimed is:

1. A cylinder lock manufacturing method for a plurality of cylinder locks differing in place of use but using a common key for their unlocking comprising:

carrying out the following steps on said plurality of cylinder locks and said key as a group having a specific key code assigned thereto on a free flowing assembly operation having a plurality of work stations operating in series one after another;

assembling inner members and outer members of cylinder locks into respective cylinder locks one lock after another at respective work stations among the plurality of work stations in series continuously one group after another wherein all cylinder locks within one group are associated with the specific key code assigned thereto, further a specific key code of one group of cylinder locks being different from a specific key code of another group of cylinder locks; and synchronously with said assembling notching a key for each group of locks, and thereafter combining each group of cylinder locks and the key notched for that group of cylinder locks as a set.

2. A method of manufacturing cylinder locks for a vehicle in a free-flowing assembly operation having a plurality of work stations operating in series one after another, said cylinder locks differing in place of use in the vehicle but using a common key for their unlocking comprising:

grouping together a plurality of cylinder locks differing in place of use in the vehicle relative to one another as a group;

assigning a specific key code to the group of cylinder locks;

assembling inner and outer members into respective cylinder locks of the group at respective work stations among the plurality of work stations, one lock after another in series, one group of cylinder locks after another, while holding the key code constant for each group of cylinder locks;

synchronously with said assembling of the inner and outer members of the cylinder locks of the group notching a key blank with the specified key code assigned to the group of cylinder locks to produce a key for the group of cylinder locks;

assigning another specific key code for a following group of cylinder locks; and combining the group of cylinder locks and the key as a set as the group of cylinder locks and the key notched therefor along with other groups of cylinder locks and other keys flow along the assembly operation and are assembled in a continuous manner.

3. A method according to claim 2, wherein the step of assembling includes, providing a free-flowing line upon which are mounted pallets, setting the inner and outer members of the group of cylinder locks on an individual lock basis on one pallet, automatically inserting tumblers as the pallet moves down the line to the respective work stations of said assembly operation, and automatically assembling each inner member into the respective outer member as the pallet moves down the line to the respective work stations of said assembly operation.

4. The method according to claim 3, further comprising assigning an identification mark to each pallet holding a set of inner and outer members for one group of cylinder locks, and performing said inserting and assembling after reading said identification mark.

* * * * *